US007455037B2

(12) United States Patent
Marion et al.

(10) Patent No.: US 7,455,037 B2
(45) Date of Patent: Nov. 25, 2008

(54) GAS FASTENING APPARATUS HAVING AN INTERNAL COMBUSTION ENGINE AND GAS INDUCTION DEVICE CONNECTED BY A FLEXIBLE TUBE

(75) Inventors: Cyril Marion, Valence (FR); Frederic Nayrac, Bourg Les Valence (FR); Patrick Herelier, Saint-Jean-de-Muzols (FR)

(73) Assignee: Societe de Prospection et d'Inventions Techniques SPIT, Bourg les Valence (FR)

( * ) Notice: Subject to any disclaimer, the term of this patent is extended or adjusted under 35 U.S.C. 154(b) by 111 days.

(21) Appl. No.: 11/569,563

(22) PCT Filed: May 23, 2005

(86) PCT No.: PCT/IB2005/001394

§ 371 (c)(1),
(2), (4) Date: Nov. 22, 2006

(87) PCT Pub. No.: WO2005/118227

PCT Pub. Date: Dec. 15, 2005

(65) Prior Publication Data

US 2007/0246571 A1 Oct. 25, 2007

(30) Foreign Application Priority Data

May 25, 2004 (FR) ..... 04 05606

(51) Int. Cl.
*F02B 71/00* (2006.01)
*F02B 43/00* (2006.01)

(52) U.S. Cl. ..... 123/46 R; 123/527

(58) Field of Classification Search ..... 123/46 R, 123/46 SC, 46 H, 527; 239/525
See application file for complete search history.

(56) References Cited

U.S. PATENT DOCUMENTS

| | | | | |
|---|---|---|---|---|
| 5,873,508 | A | 2/1999 | MacVicar | |
| 6,098,652 | A | 8/2000 | Brandt | |
| 6,102,270 | A | 8/2000 | Robinson | |
| 6,217,085 | B1 | 4/2001 | Toulouse | |
| 6,223,966 | B1 * | 5/2001 | Nayrac et al. | 227/130 |
| 6,260,519 | B1 | 7/2001 | Phillips | |
| 2003/0111135 | A1 | 6/2003 | Vallon | |

FOREIGN PATENT DOCUMENTS

| | | | |
|---|---|---|---|
| EP | 0936031 | A | 8/1999 |
| EP | 1327501 | A | 7/2003 |

* cited by examiner

*Primary Examiner*—Hai H Huynh
(74) *Attorney, Agent, or Firm*—Lowe, Hauptman, Ham & Berner, LLP

(57) ABSTRACT

The apparatus includes a handle (1) with a gas cartridge housing and the gas induction device (4) designed to be mounted on the cartridge and connected to the engine. The engine and the induction device (4) are connected by a flexible tube mounted on the induction device side on an end fitting (6) designed to be engaged in a base (7) of the induction device and to cooperate with means (15, 17) of the handle (1) of the apparatus designed to push the connector (6) against the induction device (4).

7 Claims, 3 Drawing Sheets

GAS FASTENING APPARATUS HAVING AN INTERNAL COMBUSTION ENGINE AND GAS INDUCTION DEVICE CONNECTED BY A FLEXIBLE TUBE

RELATED APPLICATIONS

The present application is a National Phase entry of International Application Number PCT/IB2005/001394, filed May 23, 2005, which claims priority from, French Application Number 0405606, filed May 25, 2004, the disclosures of which are hereby incorporated by reference herein in their entirety.

This invention relates to gas fastening apparatus, including an internal combustion engine supplied with flammable gas and in which the explosion of a mixture of the gas and air drives a piston for driving a fastening element in a cylinder. The flammable gas arrives in the combustion chamber of the engine from a solenoid valve mounted on a gas cartridge.

The engine is generally disposed in the body of the apparatus, whereas the cartridge and the solenoid valve are disposed in the handle of the apparatus. The solenoid valve and the engine are of course connected together. Nowadays, this is effected by means of relatively complex components, the gas being forced to follow a path which bends in certain places. This results in losses of pressure and in chamber filling times which do not promote good rates of fire. It should be noted in passing that, in the context of this application, a firing period takes place between the application of the apparatus and the actuation of the trigger. It is this period that is too long.

The Applicant has therefore attempted to eliminate the bends in the connection between the solenoid valve of the gas cartridge and the engine of the gas fastening apparatus.

To this end, the invention relates to a gas fastening apparatus comprising a body with an internal combustion engine and a handle with a gas cartridge housing and a gas induction device designed to be mounted on the cartridge and connected to the engine, characterised in that the engine and the induction device are connected by a flexible tube mounted on the induction device side on an end fitting designed to be engaged in a base of the induction device and to cooperate with means of the handle of the apparatus designed to push the connector against the induction device.

As the connector is pushed against the induction device (solenoid valve), it remains held against the device in spite of the pressure in the gas cartridge.

The connector advantageously includes a bearing collar designed to cooperate with a pusher of the handle.

The collar preferably includes a spherical bearing surface against which the pusher is to come to bear.

The pusher may have a cylindrical enveloping surface having the same axis as the induction device.

The pusher also preferably has a spherical enveloping surface having a centre disposed substantially on the outlet orifice of the induction device.

By virtue of this, not only can the induction device rotate about its axis, but the connector can also rotate about its own axis while remaining applied to the base of the induction device by virtue of the cooperation between the two spherical bearing and pushing surfaces.

In the preferred embodiment of the apparatus of the invention, the pusher means of the handle are provided on at least one transverse fin of the handle.

The invention will be more readily understood with the aid of the following description of the preferred embodiment of the apparatus, with reference to the accompanying drawings, in which.

Figure 1:
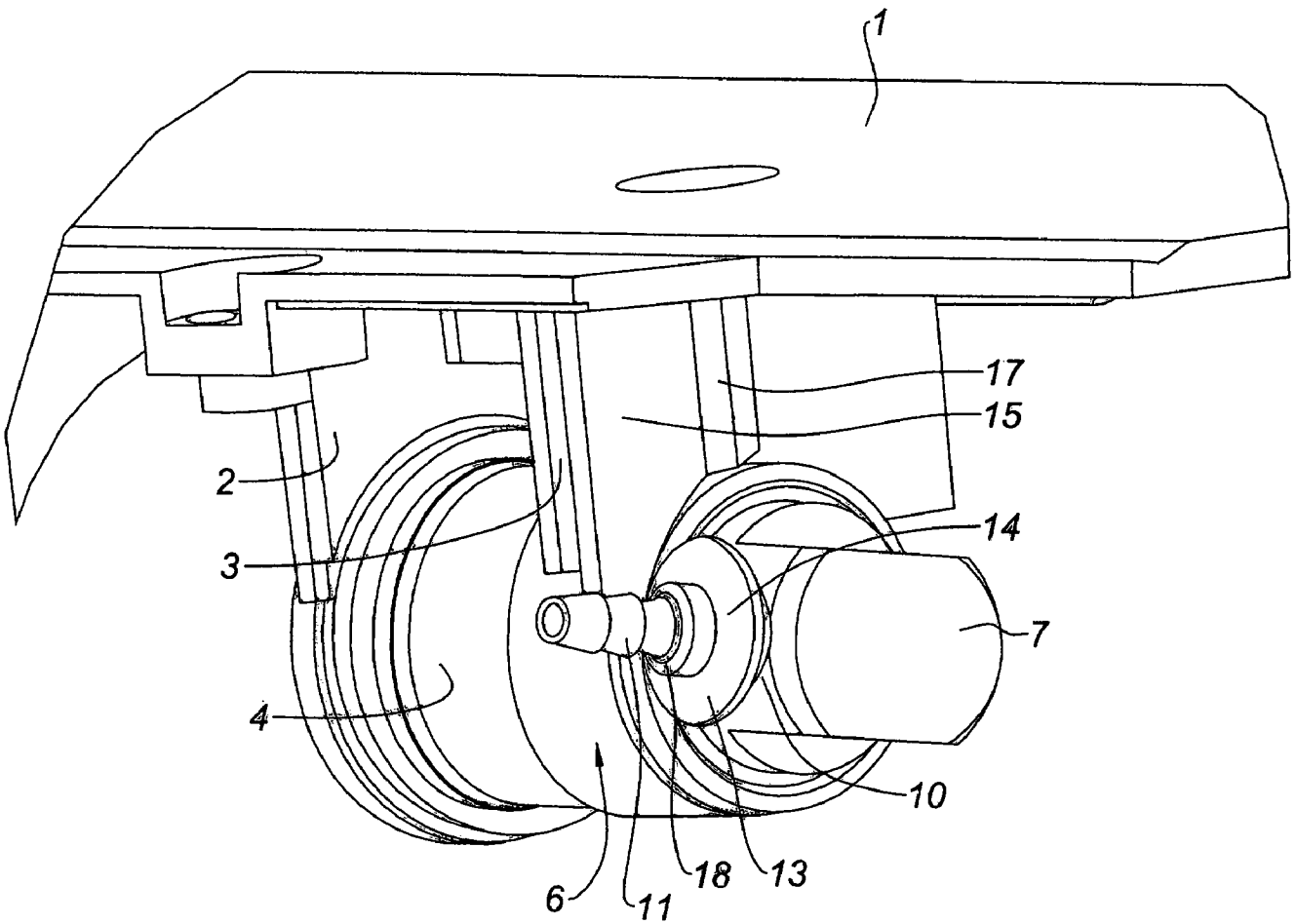
FIG. 1 is a perspective view of one shell of the handle of the apparatus of the invention, with the solenoid valve in a first angular position.

As the invention of this application concentrates essentially, not to say exclusively, on the connector situated in the handle of the apparatus, it has been deemed pointless to extend the description of the apparatus beyond this handle, the remainder of the apparatus being perfectly well known to the person skilled in the art.

The handle of the apparatus is in this case made of two shells assembled together, only one of which 1 is shown in the drawing, the one provided with the pusher fin of the invention.

Figure 2:
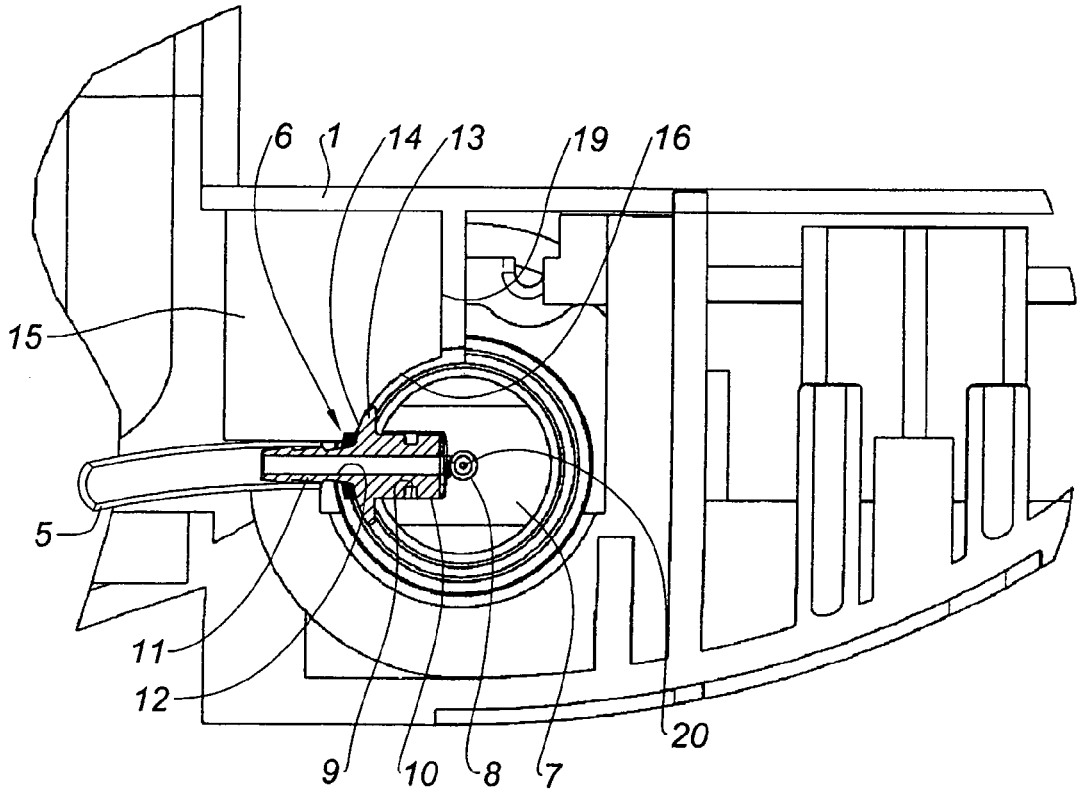
FIG. 2 is a sectional view in a plane containing the axis of the solenoid valve and the connector.

Fins or reinforcements 2, 3 for holding the solenoid valve 4 intended to supply the combustion chamber of the internal combustion engine of the apparatus by means of a flexible tube 5 (FIG. 2) threaded over a connector 6 extend transversely to the shell 1.

The solenoid valve 4 includes an outlet base 7 in which extends an outlet bore which, during operation, is in communication with the interior of the gas cartridge and which ends in an outlet orifice 8 (FIG. 2) intended, still during operation, to be virtually covered by the connector 6. In fact, the outlet orifice 8 is provided in a transverse recess 9 in the solenoid valve base 7 intended to receive the connector 6.

The connector 6, in this case made in one piece, includes a base 10 intended to be introduced freely, not by force, but in a controlled manner, into the outlet bore 9 in the base 7 of the solenoid valve and a head 11, in this case notched, introduced into the flexible connecting tube 5. The body of the end fitting is traversed by a bore 12 extending from the base 10 to the head 11 for the passage of the gas of the gas cartridge.

A radially projecting annular collar 13 the surface 14 of which directed towards the end fitting head 11 is spherical and is centred substantially on the outlet orifice 8 extends in the middle zone of the body of the end fitting between its base 10 and its head 11.

Another transverse fin 15 situated at right angles with the collar 13 of the end fitting 6 when the components are in their operating positions and the surface portion 16 of which directed towards the solenoid valve is a spherical surface portion having the same radius of curvature as the surface 14 of the collar 13 is provided on the shell 1 beside the retaining fin 3. The fin 15 is extended on one side, the shorter side 19, by an angle section 17, in this case a right-angled section, intended to ensure the same pushing function of the end fitting 6, but also a stop function for the angular indexing of the solenoid valve by virtue of the flats on the outlet base 7. An annular shoulder 18 at the join of the end fitting head 11 and the collar 13 serves as a stop for the flexible tube.

As the handle of the apparatus comprises two shells, it is easy to envisage providing the second shell (not shown in the drawings) with the same retaining and pushing fins as those of the shell 1.

By virtue of the cooperation between the pushing fin 15 and the bearing collar 13, the connector 6 remains held in its housing 9 of the base 7 of the solenoid valve 4 in spite of the pressure in the gas cartridge, the flow of the gas from the solenoid valve 4 through the end fitting 6 and the tube 5 thereby being ensured.

By virtue of the spherical nature not only of the collar 13, but also of the transverse edge 16 of the pushing fin 15, not only can the solenoid valve 4 rotate about its axis 20, but the connecting tube 5 with its end fitting 6 can also rotate about its axis without thereby disrupting the cooperation between the bearing and pushing surfaces.

Figure 3:
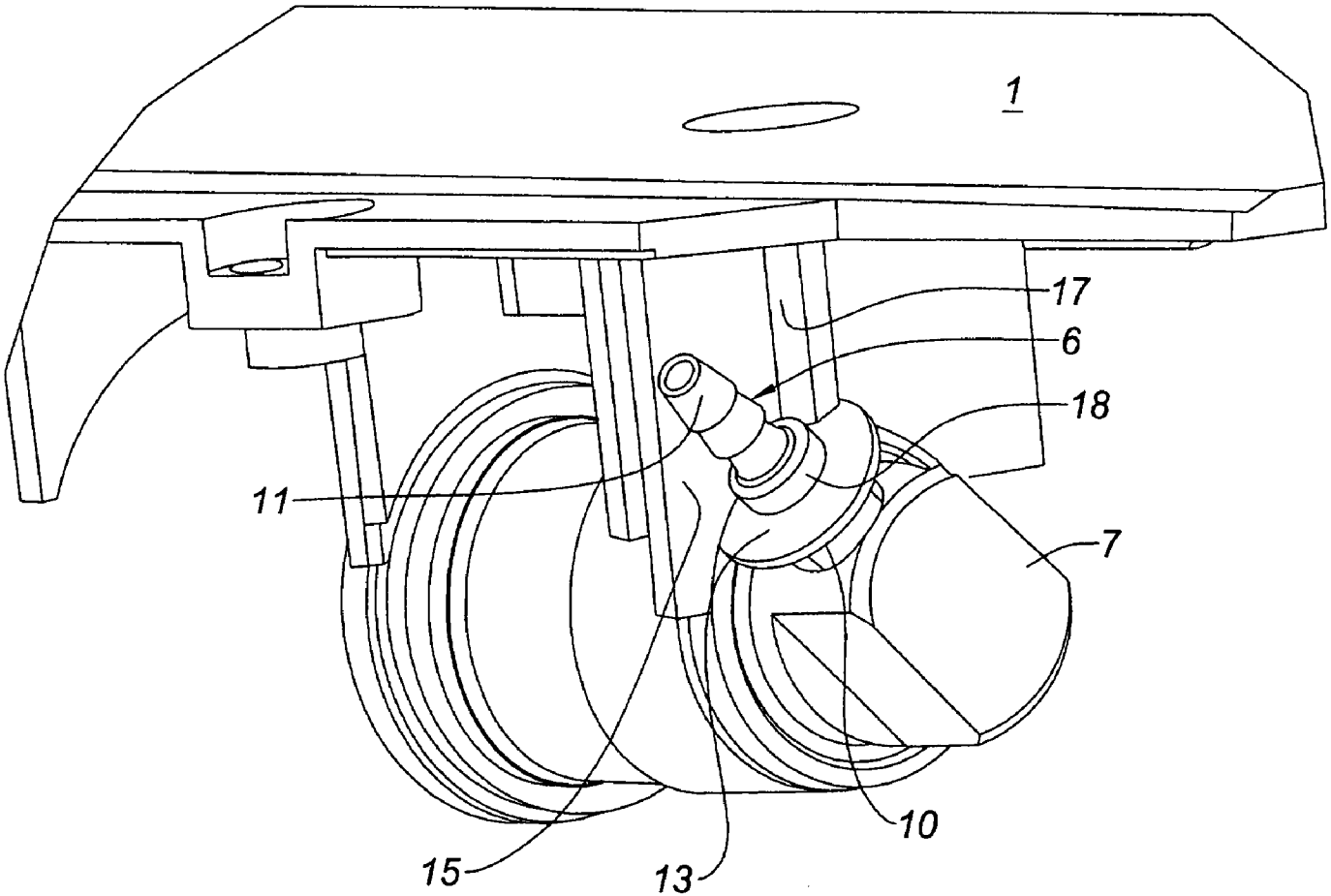
FIG. 3 is a perspective view similar to that of FIG. 1, after slight rotation of the solenoid valve about its axis.

In the position of FIG. 3, the solenoid valve has rotated about its axis through an angle of approximately 30°, the end fitting 6 bearing against the angled fin 17, but still being held in its bore in the solenoid valve base.

The invention claimed is:

1. A fastening apparatus comprising a body with an internal combustion engine and a handle with a gas cartridge housing and a gas induction device adapted to be mounted on the cartridge and connected to the engine, wherein the engine and the induction device are connected by a flexible tube mounted on the induction device side on an end fitting adapted to be engaged in a base of the induction device and to cooperate with the handle of the apparatus adapted to push a connector against the induction device.

2. Apparatus according to claim 1, wherein the connector includes a bearing collar adapted to cooperate with a pusher of the handle.

3. Apparatus according to claim 2, wherein the collar includes a spherical bearing surface against which the pusher is to come to bear.

4. Apparatus according to claim 2, wherein the pusher has a cylindrical enveloping surface having the same axis as the induction device.

5. Apparatus according to claim 2, wherein the pusher has a spherical enveloping pushing surface having a center disposed substantially on an outlet orifice of the induction device.

6. Apparatus according to claim 1, wherein the pusher of the handle is provided on at least one transverse fin of the handle.

7. Apparatus according to claim 1, wherein the connector includes a base intended to be received in a housing of the base of a solenoid valve.

* * * * *